US010086995B2

(12) United States Patent
Jordan, Jr.

(10) Patent No.: US 10,086,995 B2
(45) Date of Patent: Oct. 2, 2018

(54) LANDSCAPING LAWN TARPAULIN AND SYSTEM

(71) Applicant: James D. Jordan, Jr., Grove City, OH (US)

(72) Inventor: James D. Jordan, Jr., Grove City, OH (US)

( * ) Notice: Subject to any disclaimer, the term of this patent is extended or adjusted under 35 U.S.C. 154(b) by 0 days.

(21) Appl. No.: 15/414,916

(22) Filed: Jan. 25, 2017

(65) Prior Publication Data

US 2017/0210557 A1 Jul. 27, 2017

Related U.S. Application Data

(60) Provisional application No. 62/286,572, filed on Jan. 25, 2016.

(51) Int. Cl.
*B65F 1/00* (2006.01)

(52) U.S. Cl.
CPC ..... *B65F 1/00* (2013.01); *B65F 1/0006* (2013.01); *B65F 2240/138* (2013.01)

(58) Field of Classification Search
CPC ..... B65F 1/002; B65F 1/0006; B65F 1/10; B65F 1/14; B65F 2001/1489; B65F 2240/138; B65F 1/00
USPC ..... 294/152, 214
See application file for complete search history.

(56) References Cited

U.S. PATENT DOCUMENTS

| | | | | |
|---|---|---|---|---|
| 4,738,477 | A * | 4/1988 | Grossmeyer | A01G 1/12 15/257.1 |
| 4,955,068 | A * | 9/1990 | Tennihan | B65B 67/12 141/114 |
| 5,066,143 | A * | 11/1991 | Sanders | B65D 33/28 294/152 |
| 5,178,426 | A * | 1/1993 | David | A01K 1/0107 119/161 |
| 7,249,792 | B1 * | 7/2007 | Bunten | B65F 1/00 294/152 |
| D611,670 | S * | 3/2010 | Booth | D34/1 |
| 8,544,922 | B1 * | 10/2013 | Huzar | B65D 85/52 294/157 |
| D765,929 | S * | 9/2016 | Mataya | D32/35 |
| 2006/0232082 | A1 * | 10/2006 | Tiura | B65F 1/00 294/214 |
| 2007/0138198 | A1 * | 6/2007 | Levy | A45C 9/00 221/45 |
| 2008/0205973 | A1 * | 8/2008 | Drawdy | A01D 51/00 402/80 L |

(Continued)

*Primary Examiner* — Dean J Kramer
(74) *Attorney, Agent, or Firm* — Miracle IP; Bryce D. Miracle

(57) ABSTRACT

In accordance with the invention, a landscaping lawn tarpaulin and system is provided which boasts the ability to provide a unique way of loading and transporting landscaping debris and other objects by utilizing one or more compact sized tarpaulins in which the user can easily load, pick up, transport, and dump objects. The invention generally comprises a loading surface formed by a flexible substantially rectangular sheet of material having four corners; and a flexible handle extending laterally outward and integral with the loading surface at each corner. The tarpaulin is fabricated from a flexible material such as a shade mesh or a shade cloth which enables the tarpaulin to flex into a unique pod shape while transporting its content.

2 Claims, 4 Drawing Sheets

(56) References Cited

U.S. PATENT DOCUMENTS

| | | | | |
|---|---|---|---|---|
| 2013/0195383 | A1* | 8/2013 | Daugs, Jr. ..... | B65D 51/00<br>383/12 |
| 2014/0252002 | A1* | 9/2014 | Donoghue ..... | B65F 1/1415<br>220/495.09 |

* cited by examiner

LANDSCAPING LAWN TARPAULIN AND SYSTEM

This application is based upon and claims the priority filing date of the previously filed, U.S. Provisional patent application entitled "LANDSCAPING LAWN TARPAULIN SYSTEM" filed Jan. 25, 2016, Ser. No. 62/286,572, the entire disclosure of which is hereby incorporated herein by reference.

BACKGROUND

The present invention relates to a lawn tarpaulin and system thereof and, in particular, to an improved lawn tarpaulin that can easily hold and transport various gardening and landscape refuse and debris while landscaping.

A tarpaulin, or tarp, is a large sheet of strong, flexible, water-resistant or waterproof material, often cloth such as canvas or polyester coated with urethane, or made of plastics such as polyethylene. Tarpaulins often have reinforced grommets at the corners and along the sides to form attachment points for rope, allowing them to be tied down or suspended. Inexpensive modern tarpaulins are made from woven polyethylene; this material is so associated with tarpaulins that it has become colloquially known in as polytarp.

Tarpaulins have long been used for collecting and hauling lawn refuse and litter. Problems emerge in using a simple tarpaulin for lawn refuse. Deployment of a tarpaulin on the ground requires the user to walk about the periphery unfolding the material. Moreover, tarps tend to be of larger size and are difficult to manage during windy conditions. While in transport, traditional tarps are difficult to handle; lacking special features that allow the user to effectively move, lift and transport the tarps. Furthermore, tarpaulins can be difficult and cumbersome to unload its contents to a desired location such as a receptacle or bed of a pick-up truck.

Tarpaulins are relatively satisfactory for their intended purposes. However, on the other hand, the conventional tarp lacks special features that may increase the efficiency and ease of use during handling while landscaping.

For the foregoing reason, there is a need for a tarpaulin that will provide an efficient collection surface as well as provide an efficient and reliable manner of transporting and disposing of gardening and landscape debris contained therein.

SUMMARY

In accordance with the invention, a landscaping lawn tarpaulin and system is provided which boasts the ability to provide a unique way of loading and transporting landscaping debris and other objects by utilizing one or more compact sized tarpaulins in which the user can easily load, pick up, transport, and dump objects. The invention generally comprises a loading surface formed by a flexible substantially rectangular sheet of material having four corners; and a flexible handle extending laterally outward and integral with the loading surface at each corner. The tarpaulin is fabricated from a flexible material such as a shade mesh or a shade cloth which enables the tarpaulin to flex into a unique pod shape while transporting its content.

Furthermore, the flexible tarpaulin can be utilized in conjunction with a system and method for efficiently collecting, loading, transporting and dumping various objects and other debris to a waste receptacle or other dump location such as a truck bed. The method generally comprises: (a) providing a flexible tarpaulin for transporting debris, material, and landscaping objects by a user having a first lateral side and a second lateral side, comprising: (i) a loading surface formed by a flexible substantially rectangular sheet of material having four corners; and (ii) a flexible handle extending laterally outward and integral with the loading surface at each corner; (b) deploying the flexible tarpaulin onto a flat surface or a container such as a wheelbarrow at a first location; (c) loading on the loading surface with objects and other debris; (d) lifting and transporting the flexible tarpaulin containing objects by grasping together by hand the flexible handles of the first lateral side and grasping together the opposing flexible handles of the second lateral side by the other hand; and (e) unloading the flexible tarpaulin at a second location by releasing flexible handles at the first lateral side and maintaining grip on the opposing flexible handles of the second lateral side, thereby allowing contents to fall freely into a waste receptacle or other location.

Moreover, in another method of utilization of the invention, two or more tarpaulins are utilized in conjunction with a wheelbarrow in order to efficiently collect, load, transport and dump objects and other debris. The method generally comprises: (a) providing at least two flexible tarpaulin for transporting debris, material, and landscaping objects by a user having a first lateral side and a second lateral side, comprising: (i) a loading surface formed by a flexible substantially rectangular sheet of material having four corners; and (ii) a flexible handle extending laterally outward and integral with the loading surface at each corner; (b) deploying the first flexible tarpaulin within a container such as a wheelbarrow at the first location; (c) loading on the loading surface of the first flexible tarpaulin with objects and other debris; (d) deploying a second flexible tarpaulin on top of the loaded debris of the first flexible tarpaulin; (e) loading on the loading surface of the second flexible tarpaulin with objects and other debris; (f) transporting the first and second loaded flexible tarpaulin to a second location for unloading such as a waste receptacle or truck bed; (g) lifting the second flexible tarpaulin from the container by grasping together by a hand the flexible handles of the first lateral side and grasping together the opposing flexible handles of the second lateral side by the other hand; (h) unloading the second flexible tarpaulin by releasing the flexible handles of the first lateral side and maintaining grip on opposing flexible handles of the second lateral side, thereby allowing contents to fall freely into a waste receptacle or other location; (i) lifting the first flexible tarpaulin from the container by grasping together by a hand the flexible handles of the first lateral side and grasping together the opposing flexible handles of the second lateral side by the other hand; and (j) unloading the first flexible tarpaulin by releasing the flexible handles of the first lateral side and maintaining grip on the opposing flexible handles of the second lateral side, thereby allowing contents to fall freely into a waste receptacle or other location.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Referring now to the figures wherein the showings are for purposes of illustrating a preferred version of the invention only and not for purposes of limiting the same, the present invention is a unique, specialized tarpaulin which provides an efficient, easy way to collect, lift, transport and dump landscape debris, refuse and other objects and its method of use.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

Figure 1:
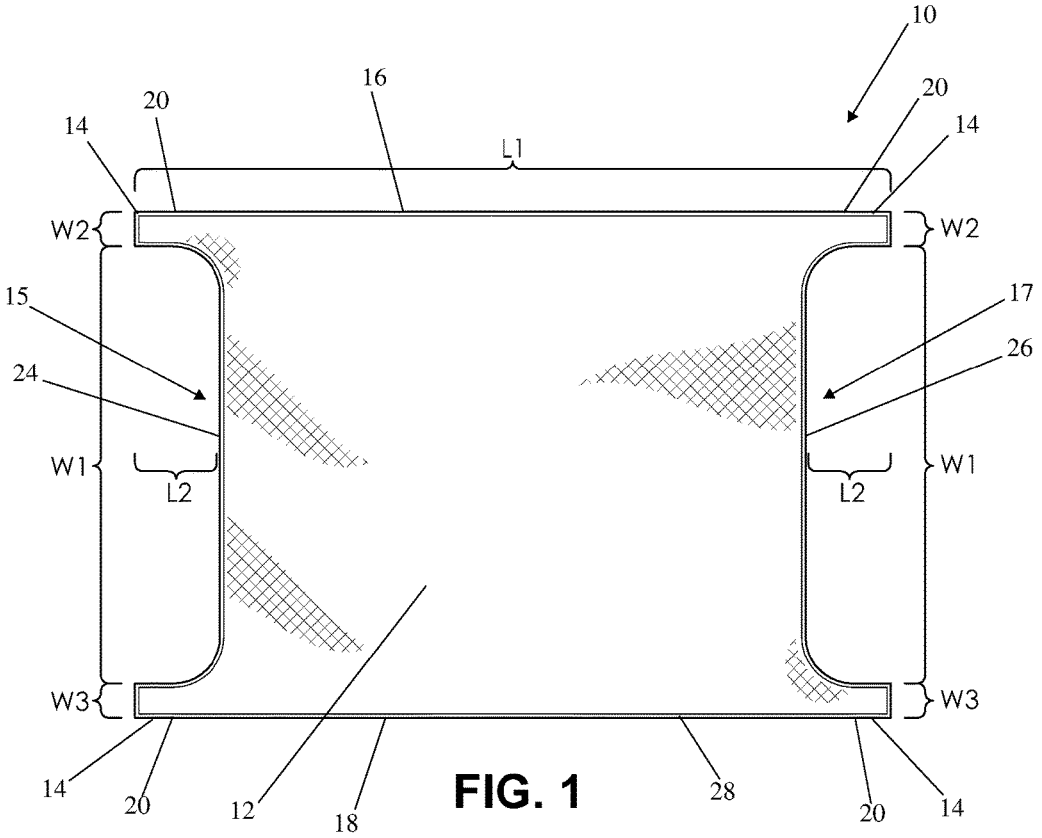
FIG. 1 is a top plan view of a first version of the invention.
Figure 2:
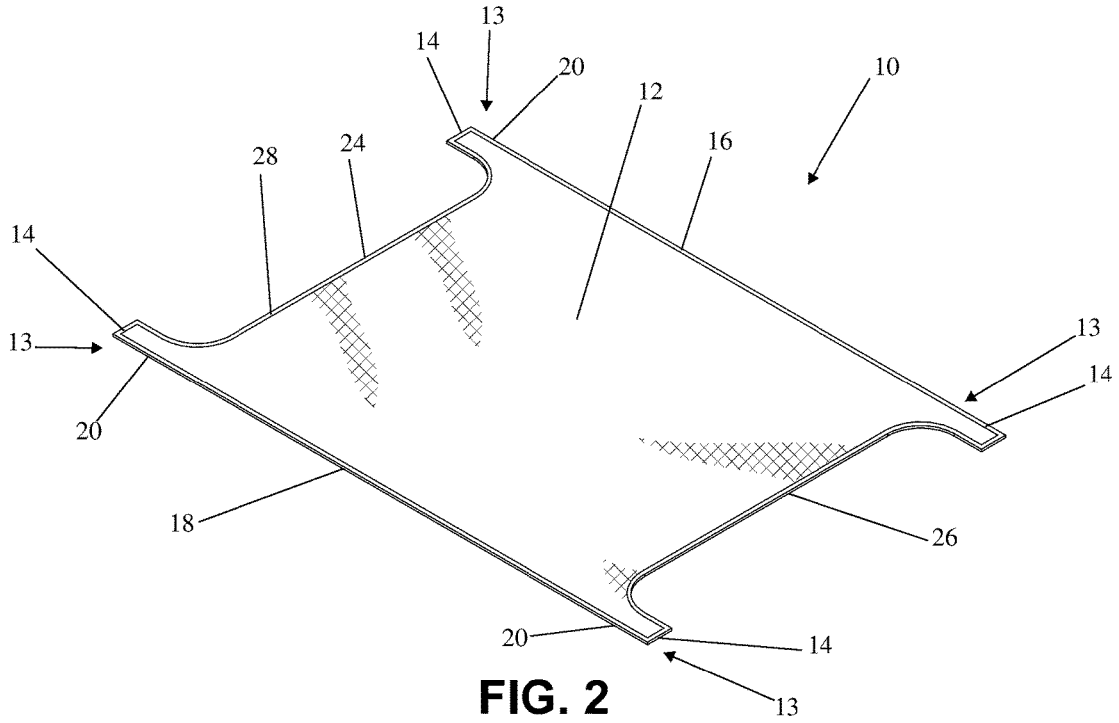
FIG. 2 is top side perspective view of the version shown in FIG. 1 showing the tarpaulin in a deployed position.

With reference to the figures, particularly FIG. 1 and FIG. 2, a description of a version of the invention will be provided. FIG. 1 is a top plan view illustrating the general shape of the tarpaulin in a deployed position and is generally indicated by the numeral 10. The flexible tarpaulin generally comprises a loading surface 12 formed by a flexible substantially rectangular sheet of material having four corners 13 and a flexible elongated handle 14 extending laterally outward and integral with the loading surface 12 at each corner 13. The flexible handle 14 length is approximately the width of a standard user hand.

Generally speaking, the tarpaulin 10 can be made of any flexible material including cloths, plastics, synthetics and composite material. Ideally, the tarpaulin 10 is made of shade mesh or shade cloth as known in the industry.

Referring to FIG. 1 the tarpaulin 10 can range in various sizes. Ideally, the general rectangular dimensions of the tarpaulin 10 is approximately 4 ft (L1) by 3 ft (W1+W2+W3). Other smaller and larger versions are envisioned such as a version that is approximately 8 ft (L1) by 6 fth (W1+W2+W3). Thus, ideal dimensions can range from 1 ft-10 ft in width by 1 ft-10 ft in length. Ideally, the overall ratio of width (W1+W2+W3) over length (L1) will be ¾.

In the illustrated version, the tarpaulin 10 generally has a first lateral side 15 and an opposing second lateral side 17, each side having opposing parallel first and second side perimeters 24, 26 Further, the tarpaulin 10 includes a first outer perimeter 16 and a second outer perimeter 18 which are in parallel.

In the illustrated version, each flexible handle 14 has an outer perimeter 20 which is congruent, linear, and integral with the corresponding first outer perimeter 16 and second outer perimeter 18. Thus, providing an even, straight edge across the first and second outer perimeters 16, 18 of the tarpaulin 10. This, provides a more efficient imprint for manufacture and fabrication from a roll of material such as shade mesh and the like.

The tarpaulin 10 also may have a reinforced perimeter as illustrated in FIG. 2, wherein a hemmed material 28 is positioned about the complete perimeter thereof. Thus, providing the tarpaulin 10 and the flexible handles 14 with structural reinforcement which increases durability and maintains structural integrity while in use.

In a version and as best illustrated by FIG. 1, the flexible handles 14 are elongated and extend laterally outward forming inner 90 degree angles with the parallel first and second side perimeters 24, 26. Thus, the flexible handles 14 horizontally extend outward at a perpendicular from the rectangular loading surface 12 as best illustrated in FIG. 1. Concurrently, the flexible handles 14 extend parallel to the first and second outer perimeters 16, 18. Ideally, the width W2, W3 of each flexible handle 14 is approximately 2 inches. However, other larger or smaller widths W2, W3 can be utilized, preferably between 1-4 inches. Moreover, preferably, the length L2 of the flexible handles is approximately six inches or approximately the width of a standard sized human hand. However, other lengths L2 can be desirable such as between 3-9 inches.

Figure 3:
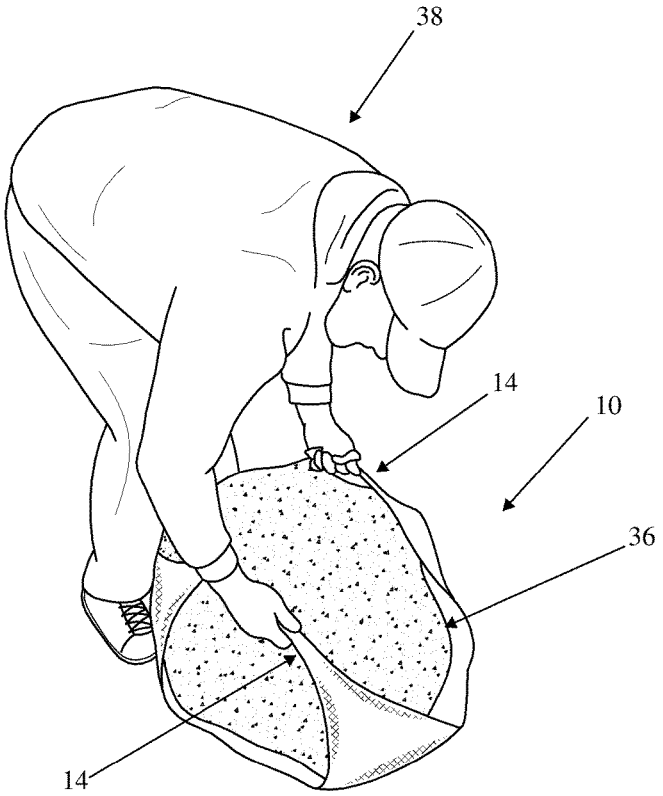
FIG. 3 is an illustrative perspective view of the version shown in FIG. 1 showing a user picking up the tarpaulin which is loaded with debris.

As best illustrated by FIG. 2-FIG. 9, the basic operation of the tarpaulin 10 will be described in detail. First, a flexible tarpaulin 10 is provided as described above which is unfolded and deployed on the ground at a first location as illustrated by FIG. 2 or placed in a container such as a wheelbarrow 30. Next the tarpaulin 10, is loaded by raking or placing debris and refuse 36 onto the loading surface 12. As best illustrated by FIG. 3, the flexible handles 14 located at each corner 13 of the tarpaulin 10 are gathered and positioned together—naturally forming a bag or pod like structure which contains and wraps about the debris and refuse 36 therein. In particular, the user 38 lifts and transports the flexible tarpaulin 10 containing objects 36 by grasping together by hand the flexible handles 14 of the first lateral side 15 and grasping together the opposing flexible handles 14 of the second lateral side 17 by the user's other hand. Thereafter, the user has the option of handling all four handles 14 with one hand or each hand grasping two adjacent side flexible handles 14. The tarpaulin 10 and contents 36 are then transported to a desired second location such as a waste receptacle or truck bed. Lastly, the contents are released from the tarpaulin 10 by maintaining a grip on at least two adjacent flexible handles 14 and releasing the opposing flexible handles. In more detail, the user 38 unloads the flexible tarpaulin 10 at a second location by releasing the flexible handles 14 at the first lateral side 15 and maintaining grip on the opposing second lateral side 17 flexible handles 14. Thus, the tarpaulin 10 unfolds and releases the contents to fall freely into a waste receptacle or other desired container such as the bed of truck.

Figure 4:
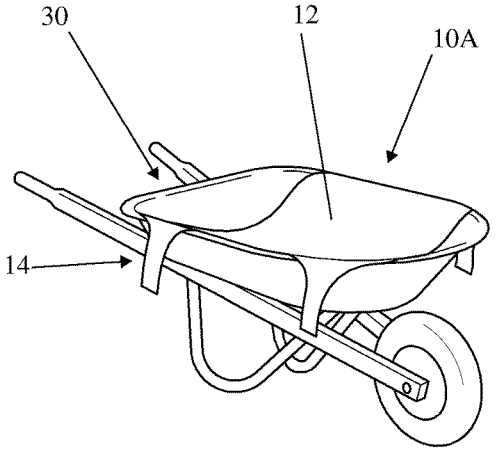
FIG. 4 is an illustrative view showing a tarpaulin as shown in FIG. 1 deployed within a wheelbarrow ready for loading.
Figure 5:
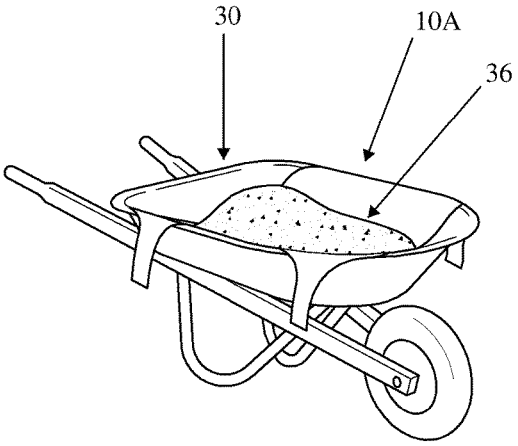
FIG. 5 is an illustrative view showing a tarpaulin as shown in FIG. 4 loaded within the wheelbarrow.
Figure 6:
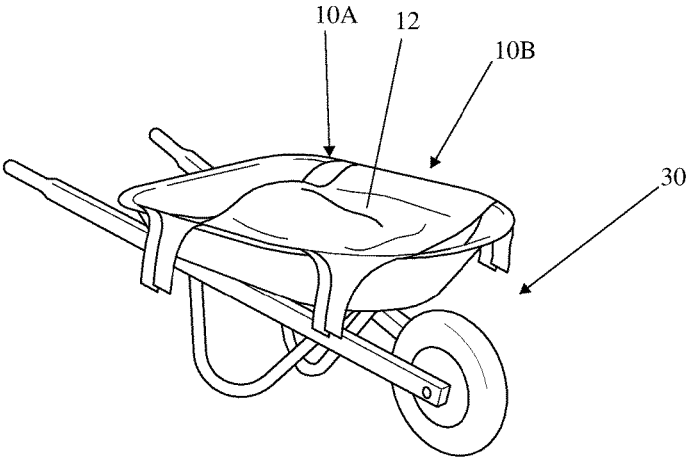
FIG. 6 is an illustrative view showing a tarpaulin system with the use of a first and second tarpaulins as shown in FIG. 1, stacked one on top of the other.
Figure 7:
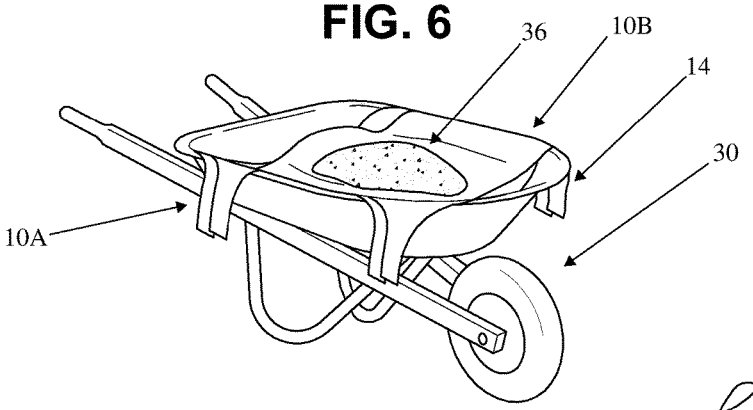
FIG. 7 is an illustrative view showing the first and second tarpaulins in the loaded configuration within a wheelbarrow.
Figure 8:
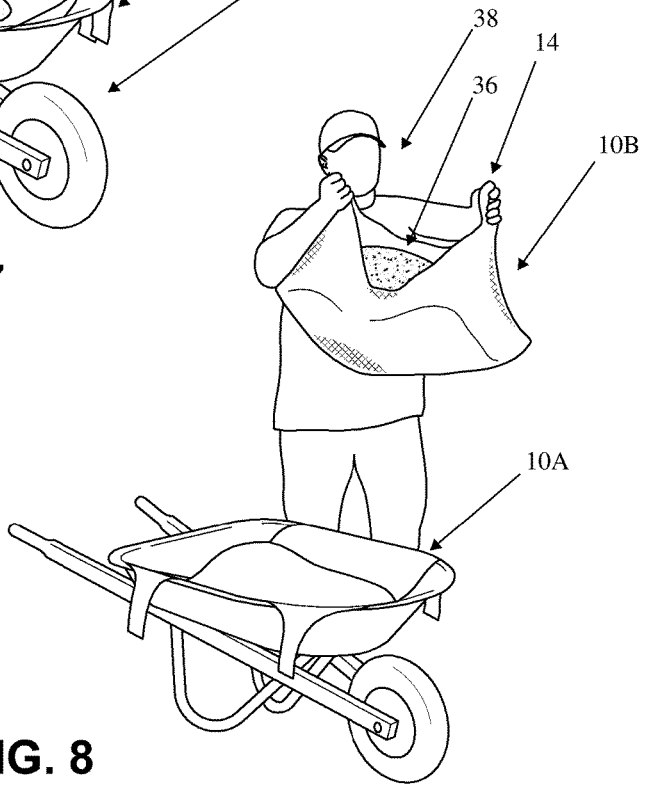
FIG. 8 is an illustrative view showing the user removing the loaded second tarpaulin from the wheelbarrow for transfer of debris or other material.

As opposed to the singular use explained above, the tarpaulin 10 can be utilized within a system of at least two tarpaulins 10A, 10B in order to provide the user with an efficient way of collecting, transporting, and dumping ample amounts of refuse and debris in conjunction with a wheelbarrow 30 or other transport device. As best illustrated in FIG. 4-FIG. 8, two or more tarpaulins 10A, 10B are provided as described individually above. Initially, for purposes of temporary storage, the tarpaulins 10A, 10B can be folded up and placed or hung over the handles of a wheelbarrow 30. 10. Next, the wheelbarrow 30 is positioned adjacent to the desired landscape/garden or a first location in which the user 38 desires to collect refuse and debris. A first flexible tarpaulin 10A is unfolded and deployed within the wheelbarrow 30 as illustrated in FIG. 4. As illustrated in FIG. 5, the wheelbarrow 30 and tarpaulin 10A is loaded with refuse and debris 36 such as excess edging and dirt as shown. Next, a second flexible tarpaulin 10B is unfolded and deployed over the loaded first tarpaulin 10A and content; thus creating a second layer within the wheelbarrow 30 (FIG. 6). Next, as illustrated by FIG. 7, the second tarpaulin 10B is loaded with debris and refuse until the wheelbarrow 30 is full. At this point, the user has the option of adding yet a third or more layers utilizing a third tarpaulin if circumstances are desirable.

Once the wheelbarrow 30 and first and second tarpaulin 10A, 10B are loaded with debris 36, the wheelbarrow 30 is transported in a conventional fashion to a second location or dump location such as a waste receptacle or the bed of a truck. For example, the wheelbarrow 30 is transported adjacent to a truck for dumping the contents therein. Each individual tarpaulin 10A, 10B is lifted as previously described, starting with the top most tarpaulin, in order to lift and dump the contents of each individual tarpaulin 10B and then tarpaulin 10A in succession into the bed of the truck or other desirable dump location.

In more detail, the user 38 first lifts the second flexible tarpaulin 10B from the wheelbarrow or container 30 by grasping together by a first hand the flexible handles 14 of the first lateral side 15 and grasping together the flexible handles 14 of the second lateral side 17 by the other hand. The user 38 then unloads the second flexible tarpaulin 10B by releasing the flexible handles 14 of the first lateral side 15 and maintaining grip on opposing flexible handles 14 of the second lateral side 17, thereby allowing contents 36 to fall freely into a waste receptacle or other location. Thereafter, the user 38 lifts the first flexible tarpaulin 10A from the container 30 by grasping together by a first hand the flexible handles 14 of the first lateral side 15 and grasping together the opposing flexible handles 14 of the second lateral side 17 by the other hand. Then, the user 38 unloads the first flexible tarpaulin 10A by releasing the flexible handles 14 of the first lateral side 15 and maintaining grip on the opposing flexible handles 14 of the second lateral side 17, thereby allowing contents to fall freely into a waste receptacle or other location.

Figure 9:
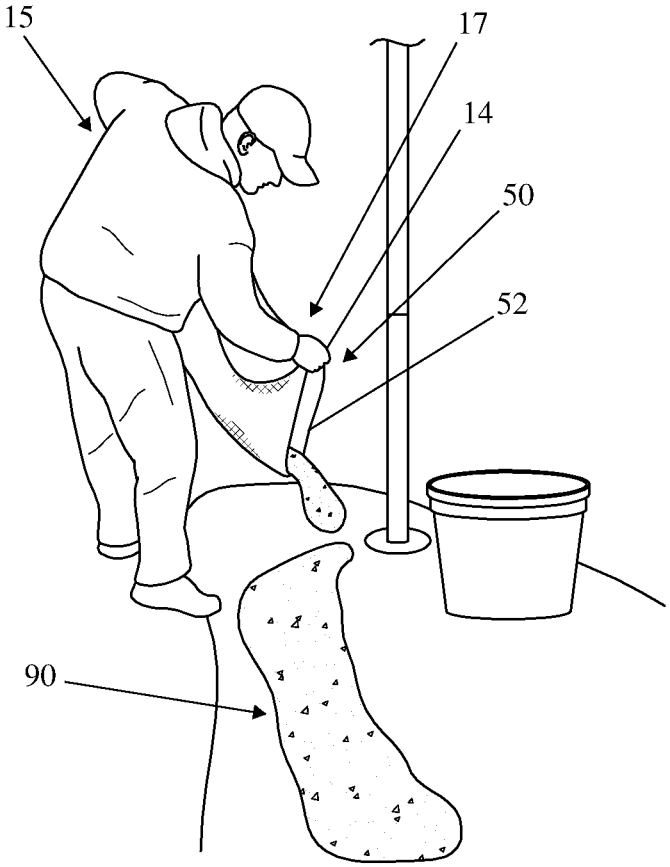
FIG. 9 is an illustrative view showing release and distribution of material held within a tarpaulin for landscaping purposes.

Moreover, as best illustrated by FIG. 9, the tarpaulin 10 can be utilized to hold and easily spread/distribute mulch 90 or other types of landscaping material by grasping the flexible handles 14 at the first lateral side 15 by a first hand and gathering and holding the flexible handles 14 at the opposing second lateral side 17 by the other hand—forming an application end 50 having a circular opening 52 sized to suit the application of different types of landscaping material (FIG. 10). In particular, the gauge of the circular opening 52 can be adjusted by increasing or decreasing the amount of overlap of the flexible handles 14 at the application end 50 tailored to the material size 90 and flow rate of the material being distributed to the garden or other landscaping.

When the tarpaulins 10A, 10B are not in use, their flexible nature allow them to easily fold up or roll up for storage purposes. Also, the tarpaulins 10 are easy to clean with water or other spray hose device.

The tarpaulin 10 can be made in any manner and of any material chosen with sound engineering judgment. Preferably, materials will be strong, flexible, lightweight, long lasting, economic, and ergonomic. Construction of the tarpaulin 10 can be made of any known material known in the landscaping or tarpaulin art such as synthetics, plastics, or cloth or a combination thereof. Ideally, the tarpaulin 10 is constructed from a quality mesh cloth.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A method for hauling objects from a first location to a second location, comprising:

(a) providing at least a first flexible tarpaulin and a second flexible tarpaulin for transporting debris, material, and landscaping objects by a user having a first lateral side and a second lateral side, each tarpaulin comprising: (i) a loading surface formed by a flexible sheet of material having four corners; and (ii) a flexible handle extending outward and integral with the loading surface at each corner;

(b) deploying the first flexible tarpaulin within a container at the first location;

(c) loading on the loading surface of the first flexible tarpaulin with objects and other debris;

(d) deploying a second flexible tarpaulin on top of the loaded debris of the first flexible tarpaulin;

(e) loading on the loading surface of the second flexible tarpaulin with objects and other debris;

(f) transporting the first and second loaded flexible tarpaulin to a second location for unloading;

(g) lifting the second flexible tarpaulin from the container by grasping together by a hand the flexible handles of the first lateral side and grasping together the opposing flexible handles of the second lateral side by the other hand;

(h) unloading the second flexible tarpaulin by releasing the flexible handles of the first lateral side and maintaining grip on opposing flexible handles of the second lateral side, thereby allowing contents to fall freely into a waste receptacle or other location;

(i) lifting the first flexible tarpaulin from the container by grasping together by a hand the flexible handles of the first lateral side and grasping together the opposing flexible handles of the second lateral side by the other hand; and (j) unloading the first flexible tarpaulin by releasing the flexible handles of the first lateral side and maintaining grip on the opposing flexible handles of the second lateral side, thereby allowing contents to fall freely into a waste receptacle or other location.

2. A method for distributing and controlling flow rate of landscaping material by a user, the method comprising:

(a) providing a flexible tarpaulin for transporting debris, material, and landscaping objects by a user having a first lateral side and a second lateral side, the tarpaulin comprising:

(i) a loading surface formed by a flexible sheet of material having four corners, the loading surface having a linear first outer edge and an opposing linear second outer edge; and (ii) a flexible handle extending outward and integral with the loading surface at each corner wherein each flexible handle has a linear outer edge which is linear and integral with its corresponding loading surface outer edge;

(b) loading on the loading surface with landscaping materials;

(c) forming an application end having a circular opening by grasping the flexible handles at the first lateral side by a first hand and balancing the second lateral side by gathering and holding the flexible handles at the opposing second lateral side by the other hand; and (d) distributing the landscaping material to a desired location through the application end, wherein the gauge of the circular opening can be adjusted by increasing or decreasing the amount of overlap of the flexible handles at the application end tailored to the landscaping material size and the desired flow rate.

* * * * *